United States Patent [19]

Motz

[11] 4,408,941

[45] Oct. 11, 1983

[54] EYEBOLT

[75] Inventor: Heinz D. Motz, Solingen, Fed. Rep. of Germany

[73] Assignee: Firma Friedrich Schroeder, Fed. Rep. of Germany

[21] Appl. No.: 237,462

[22] Filed: Feb. 23, 1981

[30] Foreign Application Priority Data

Mar. 14, 1980 [DE] Fed. Rep. of Germany ..... 3009789

[51] Int. Cl.[3] ..... F16B 35/00

[52] U.S. Cl. ..... 411/378

[58] Field of Search ..... 411/378, 400, 397, 396, 411/383, 393, 389, 388; 248/71, 74.1

[56] References Cited

U.S. PATENT DOCUMENTS 2,830,635 4/1958 Thorstens ..... 411/393

2,992,799 7/1961 Tisdell ..... 248/71

FOREIGN PATENT DOCUMENTS 445433 2/1949 Italy ..... 248/71

175870 3/1922 United Kingdom ..... 411/397

*Primary Examiner*—Robert L. Wolfe

*Attorney, Agent, or Firm*—Jacobs & Jacobs

[57] ABSTRACT

Eyebolts having increased ability to transmit forces acting obliquely to the axis of the screw portion thereof and having a slotted or apertured specially configured upper part and a threaded shank abutting the upper part and having a constriction therein, the shank being optionally provided with more than one threaded portion which can be oppositely threaded with the constricted portion therebetween.

15 Claims, 7 Drawing Figures

Fig.4
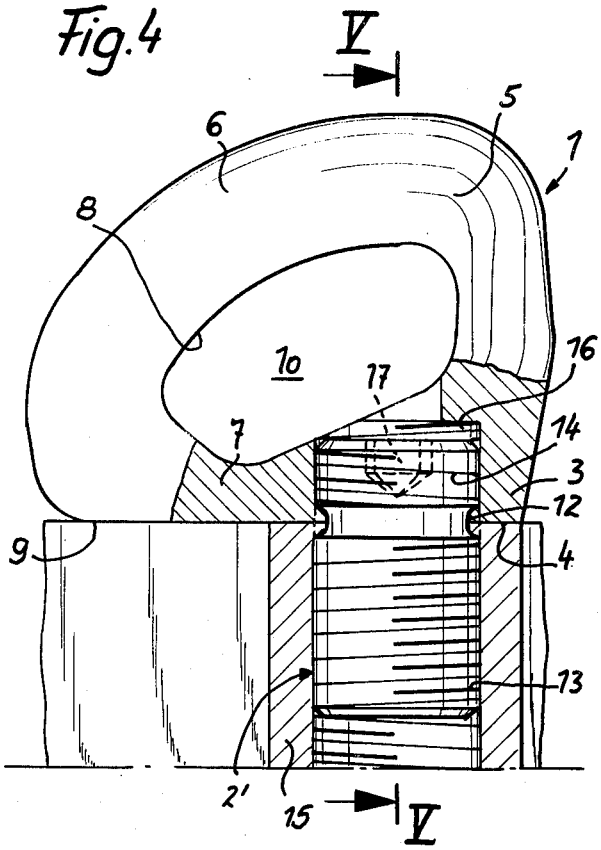
Fig.5
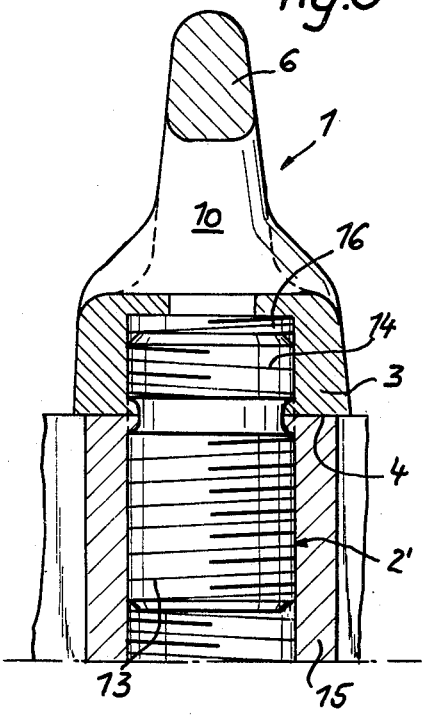
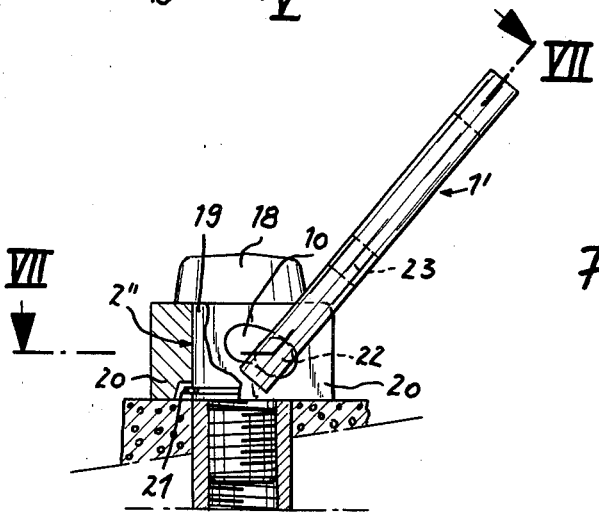
Fig.6
Fig.7
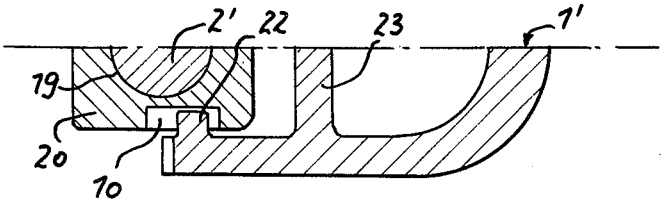

EYEBOLT

The present invention relates to an eyebolt which can be connected to a load for the attachment of a load-hoisting means, the eyebolt consisting of a threaded shank having an annularly closed eye adjoining one end of the shank and having a shoulder which can rest against the load to limit the depth of the screwing of the threaded shank.

In known eyebolts the eye is of annular shape and the threaded shank is arranged to extend radially from the periphery of the eye.

If such an eyebolt is screwed into a suitably dimensioned threaded borehole of a load and if the tractive force acts obliquely to the direction of the axis of the screw shaft then the eyebolt is subjected to an additional load in flexure, the bending moment being greater the greater, inter alia, the diameter of the annular eye.

When such eyebolts are used for connecting load-hoisting means to finished concrete parts, the eyebolt being screwed into a threaded sleeve which is grouted into the finished concrete part, it has furthermore been found that, upon oblique pull, eyebolts are capable of transmitting such large bending moments to the threaded sleeves that the latter break a short distance, in the screwing-in direction, in front of the eyebolts.

In order to prevent deformation or even destruction, both the eyebolts and the threaded sleeves have up to now been made far larger in dimensions than is necessary in itself for transmitting tractive forces acting in the longitudinal direction of the screw shank.

The object of the invention is primarily to increase the ability to transmit forces acting obliquely to the axis of the screw with less expense than heretofore.

The attainment of this object is characterized in the case of an eyebolt of the type described above by the fact that the inside of the part of the eye away from the threaded shank is curved in such a manner that its center is located at least approximately in the plane of the shoulder end facing away from the threaded shank and on the axis of the threaded shank. By these measures, even in the case of oblique pull, i.e. in the case of a line of action of the force extending obliquely to the axis of the threaded shank, the point at which said line of action intersects the axis of the threaded shank lies in the plane of that end of the eyebolt shoulder facing the threaded shank which can rest against the load or the member in which the eyebolt is screwed.

This has the advantage that no bending moments can now act, resulting in a substantially greater load-carrying capacity both of the eyebolt and of the member into which the eyebolt engages. In this connection, it is advantageous to screw the eyebolt into the threaded sleeve or the like only to such an extent that the latter can still turn by about one revolution so that it is able to adjust itself automatically under the action of the pulling force, in the direction of the acting force.

One advantageous further development of the object described above resides in the fact that the curved eye part which is away from the threaded shank is shaped so as to extend into the plane of the shoulder.

In this way, in the event of an oblique pull, the eye itself can be supported against the load, resulting in an even higher load-carrying capacity of the eyebolt.

A preferred embodiment of the above-described objective results in a significant saving in material and has a high degree of non-deformability as described hereinafter, and additional embodiments are also described which still further increase the non-deformability.

In order to make it possible in all cases for the eyebolt aligned in the direction of the acting force to rest also via the eye directly against the load in order to increase the load-carrying capacity, it is advantageous to construct the eyebolt with a threaded shank displaceable longitudinally with respect to the eye and still further embodiments with advantageous structural features are also disclosed.

These measures make it possible to screw the eye firmly against the load by means of the prefabricated bolt, regardless of the position of the starting point of the thread as described below.

A constriction in area characterizes the permissible depth of screwing of the threaded shank. By forming differently threaded zones separated from each other by the constriction in area there is assured, on the one hand, the installation of the threaded shank in correct position while, on the other hand, the depth of screwing thereof is also limited in form-locked fashion.

In addition to this, the constriction in area permits exact alignment in correct position of the eye in the direction of the active pulling force.

Another advantageous development of the above-described objective permits automatic alignment of the eye in the case of an eyebolt which is firmly connected to the load.

Illustrative embodiments of the invention are shown in the drawing wherein:

FIG. 4 is a view similar to FIG. 1 of a modified form of the invention with parts broken away partially and showing the eyebolt mounted in position;

FIG. 5 is a sectional view taken along line V—V of FIG. 4;

FIG. 6 is a front elevational view of a further embodiment of the invention substantially in longitudinal section; and FIG. 7 is a sectional view taken along line VII—VII of FIG. 6.

Figure 1:
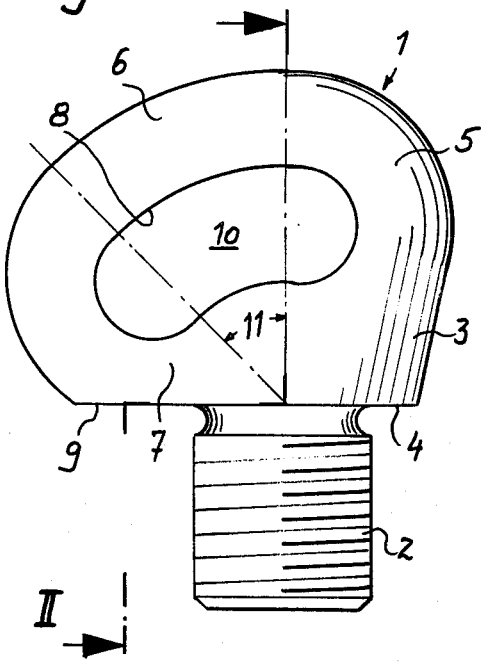
FIG. 1 is a front elevational view of an eyebolt according to the present invention.
Figure 2:
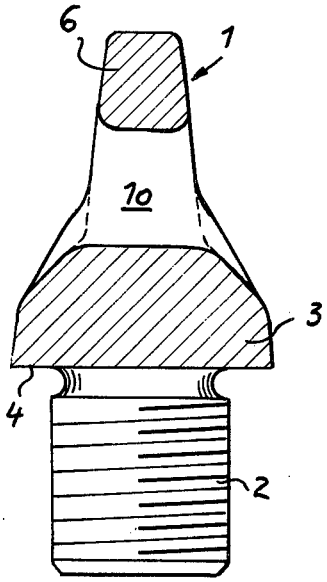
FIG. 2 is a sectional view taken on line II—II of FIG. 1.
Figure 3:
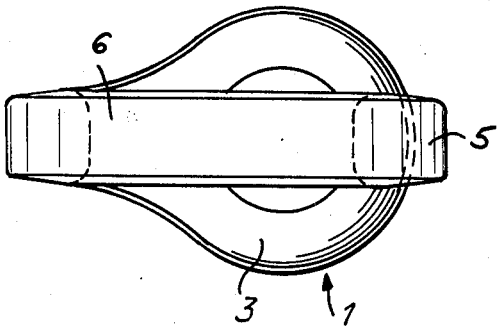
FIG. 3 is a plan view of the eyebolt of FIG. 1 taken from above.

The eyebolt shown in FIGS. 1 to 3 is made of a single piece, in particular a forging, and consists essentially of an eye 1, a threaded shank 2 having a constricted portion adjacent the eyebolt and a shoulder 3 which limits the depth of screwing thereof, the underside 4 of said shoulder which faces the threaded shank being adapted to rest against a load.

The eye 1 is of asymmetric configuration and has three eye parts 5, 6 and 7 arranged endlessly one behind the other. The first eye part 5 commences at the shoulder 4 and extends from the same approximately parallel to the axis of the threaded shank.

Adjoining this eye part 4 is the eye part 6, the inner surface 8 of which is so curved that its center lies in the plane of the shoulder underside and on the axis of the threaded shank.

The third eye part 7, which adjoins the second eye part 6, and extends into the shoulder 4 is so directed that its outer surface 9 extends in the plane of the underside 4 of the shoulder.

The eye opening is the form of a slot 10 which is curved in a manner corresponding to the inner surface 8. Said eye 1 can transmit tractive forces to the threaded shank free of moment up to an oblique pulling angle 11 of about 45°.

Even with oblique pulling angles of more than 45° the bending forces which act on the threaded shank 2 are considerably less than in the case of known eyebolts.

In FIGS. 4 and 5 the eye 1 which is substantially identical to the eye shown in FIGS. 1 to 3 has associated with it a prefabricated threaded shank 2'. The latter has two threaded zones 13 and 14 of the same nominal diameter which are separated from each other by a constriction in area 12.

However, the threaded zone 13 is screwed into a threaded sleeve 15 and is provided with a right-hand thread while the other threaded zone 14 is provided with a left-hand thread.

The thread sleeve 15 is firmly anchored in a load, for instance a prefabricated concrete part.

The threaded zone 14 is screwed into a threaded passage hole 16 in the eyebolt which is formed in a manner corresponding to said zone.

The passage hole is arranged so as to extend coaxially in the shoulder 3 of the eye and into the opening of the eye. In the upper end of the threaded shank there is provided a wrench attachment 17, preferably in the shape of a hexagonal recess into which a suitable wrench can be inserted for the turning of the threaded shank in order, even after the proper alignment of the eyebolt, to be able to fix or secure it in such a manner that both the inner surface 8 and the under surface 9 rest without play against the load.

The threaded shank 2'' of the modified eyebolt shown in FIGS. 6 and 7 has a head 19 formed thereon and furthermore an unthreaded cylindrical shank zone 19 adjoining said head in the direction towards a threaded zone.

On said shank zone 19 there is supported for free rotation a ring 20 which is fixed in axial direction by the head 18 and a circlip 21 arranged on the shank. In each of two flat parallel sides of the ring 20 facing away from each other there is arranged a slot 10, the shape and arrangement of which correspond to the eye opening of the eyebolt shown in FIGS. 1 to 3.

Within each slot 10 there is supported in transversely displaceable manner a cylindrical coupling pin 22, the pins extending coaxially to each other from a common member 1'.

On the member 1'' there is, in addition to the coupling pins 22, also a transverse arm 23 as seen in FIG. 7.

The invention comprises the individual features and combinations of features described and illustrated and variations thereof within the scope of the appended claims.

I claim:

1. An eyebolt adapted to be connected to a load and to be coupled to a load hoisting means, comprising a threaded shank connected by a constricted portion to a one-piece eye portion having an eye opening therein and having a shoulder which limits the depth of screwing of the threaded shank and which shoulder is adapted to rest against the load, the inner surface of the eye opening which faces away from the threaded shank being so curved that its center is located at least approximately in the plane of the underside of the shoulder facing the threaded shank and aligned with the axis of the threaded shank.

2. An eyebolt according to claim 1, wherein the curved eye part opening which faces away from the threaded shank is formed so as to extend up into the plane of the shoulder.

3. An eyebolt according to claim 1, wherein the eye is asymmetric with relation to the vertical axis of the eyebolt and has three eye parts arranged endlessly one behind the other and defining therewithin the said opening, the first eye part commencing on the shoulder and extending from it at least approximately parallel to the axis of the screw shank, the second eye part being curved and adjoining it, and the third eye part adjoining the second eye part and being directed at least approximately linearly towards the starting point of the first eye part.

4. An eyebolt according to claim 3, wherein the third eye part is arranged in the same direction as the undersurface of the shoulder which faces the threaded shank.

5. An eyebolt according to claim 3, wherein the undersurface of the third part of the eye which faces the threaded shank is arranged at the same level as the undersurface of the shoulder which faces the threaded shank.

6. An eyebolt according to claim 1, wherein the eye opening is shaped as a curved slot directed in the same direction as the inner surface of the second curved eye part, said slot having an at least approximately identical inside opening over its entire length.

7. An eyebolt according to claim 1, wherein the threaded shank is displaceable in a longitudinal direction with relation to the axis of the threaded shank with respect to the eye and can be locked in position.

8. An eyebolt according to claim 1, wherein the eye has a threaded passage hole which opens into the opening of the eye and into which the threaded shank engages in screwable manner opposite to the eye, and a wrench attachment arranged on the end part of the threaded shank which faces the eye.

9. An eyebolt according to claim 9, wherein the wrench attachment is arranged in the end side of the threaded shank which faces the eye opening and is shaped in particular as a recessed polygon.

10. An eyebolt according to claim 1, wherein the constricted portion in the threaded shank is disposed at a distance between said area of constriction and the under side of the threaded shank which faces the eye opening corresponding approximately to the length of the threaded passage bore.

11. An eyebolt according to claim 1, wherein a first threaded zone of the threaded shank faces the eye and, so that the threaded passage bore in the eye has a left-hand thread while a second threaded zone which is separated from the first threaded zone by the constriction in area has a right-hand thread.

12. An eyebolt according to claim 10, wherein the axial length of the unthreaded constriction corresponds at least to the thread pitch.

13. An eyebolt according to claim 11, wherein the first and second threaded zones have unlike thread pitches and/or thread shapes.

14. An eyebolt according to claim 1, wherein the eye and the threaded shank are connected with each other relatively around the longitudinal axis of the threaded shank.

15. An eyebolt according to claim 14, wherein the threaded shank is provided with a head on one end part thereof, and on the threaded shank and in particular on a thread-free zone thereof a ring is supported for rotation around the axis of the shank and is adapted to rest in an axial direction against the head, there being a slot in the shape of a circular arc provided in each of two sides of the ring facing each other, the slots being diametrically opposite each other, and a separate coupling pin engaging each slot in transversely displaceable manner, said pins extending in a direction coaxial to each other from a prefabricated eye.

* * * * *